US009027271B2

(12) United States Patent
Bronzoni

(10) Patent No.: US 9,027,271 B2
(45) Date of Patent: May 12, 2015

(54) POSTER HOLDER

(75) Inventor: Pier Luigi Bronzoni, Turin (IT)

(73) Assignee: New Rainbow S.N.C., Turin (IT)

( * ) Notice: Subject to any disclaimer, the term of this patent is extended or adjusted under 35 U.S.C. 154(b) by 0 days.

(21) Appl. No.: 14/125,075

(22) PCT Filed: Apr. 23, 2012

(86) PCT No.: PCT/IB2012/052039

§ 371 (c)(1),
(2), (4) Date: Mar. 14, 2014

(87) PCT Pub. No.: WO2012/168805

PCT Pub. Date: Dec. 13, 2012

(65) Prior Publication Data

US 2014/0182178 A1 Jul. 3, 2014

(30) Foreign Application Priority Data

Jun. 10, 2011 (WO) ..... PCT/IT2011/000193

(51) Int. Cl.

| | |
|---|---|
| ***G09F 7/22*** | (2006.01) |
| ***G09F 7/18*** | (2006.01) |
| ***G09F 7/20*** | (2006.01) |
| ***G09F 15/00*** | (2006.01) |

(52) U.S. Cl.

CPC .. *G09F 7/18* (2013.01); *G09F 7/20* (2013.01); *G09F 15/0018* (2013.01); *G09F 2007/186* (2013.01)

(58) Field of Classification Search

CPC ..... G09F 7/20; G09F 7/18; G09F 7/22; G09F 2007/186; G09F 15/00; G09F 11/29; G09F 17/00

USPC ..... 40/617, 514, 601, 603; 160/318, 263; 296/37.6

See application file for complete search history.

(56) References Cited

U.S. PATENT DOCUMENTS

| | | | | | |
|---|---|---|---|---|---|
| 1,258,940 | A | * | 3/1918 | Paul | 160/318 |
| 1,576,034 | A | * | 3/1926 | Butt | 108/134 |
| 1,792,846 | A | * | 2/1931 | Laraway | 160/263 |
| 3,062,381 | A | * | 11/1962 | Maiden | 211/105.6 |

(Continued)

FOREIGN PATENT DOCUMENTS

| | | | |
|---|---|---|---|
| FR | 2936896 | A1 | 4/2010 |
| JP | 08-123328 | A | 5/1996 |
| SE | 0901535 | A1 | 6/2011 |

OTHER PUBLICATIONS

International Search Report in Corresponding PCT Application PCT/IB2012/052039 Dated Jul. 3, 2012.

*Primary Examiner* — Casandra Davis

(74) *Attorney, Agent, or Firm* — Hedman & Costigan, P.C.; James V. Costigan; Kathleen A. Costigan

(57) ABSTRACT

The present invention relates to a poster holder (10,10',10", 10'",1000) comprising a support (3,3',3",3*, 3000) intended to be suspended on a wall and provided with at least one engagement seat (6, 600,6",6*,6'") and with a bar (4,4',4") comprising in turn a fixed length lower portion (18, 18',18") comprising a gripping device for engaging an edge of a poster (5) and at least one slider (11,11',11",11'",1100) slidably associated to said lower portion (18, 18',18"), said slider (11,11',11",11'",1100) being insertable into said engagement seat (6, 600,6",6*,6'") such to make a connection between said support (3,3',3",3*) and said bar (4, 4',4").

10 Claims, 11 Drawing Sheets

(56) References Cited

U.S. PATENT DOCUMENTS 3,495,346 A * 2/1970 Gilmoure ..... 40/617
5,428,913 A * 7/1995 Hillstrom ..... 40/604
5,676,415 A * 10/1997 Ament et al. ..... 296/37.16
5,961,172 A * 10/1999 Ament et al. ..... 296/37.16
6,493,973 B1 * 12/2002 Nelson ..... 40/607.12
8,596,594 B2 * 12/2013 Shevick ..... 248/200.1
2008/0148613 A1 * 6/2008 Lefebvre ..... 40/601

* cited by examiner

POSTER HOLDER

TECHNICAL FIELD

The present invention relates to a poster holder, and more particularly to a poster holder to be suspended from the ceiling of any room and usable, for example, as a support for advertisement placards.

PRIOR ART

Poster holders currently used in supermarkets, shopping centres and the like are generally composed of a metal bar having a rectangular or circular cross-section and having a cavity along its longitudinal axis; the bar is usually horizontally arranged.

The cavity houses a set of rollers made of plastic material or aluminium that are opposite each other and close together so as to retain the poster edge.

It has to be pointed out that, in order to make these posters more visible, the bar is usually hung at a considerable height from the floor (usually from a minimum of 2.80 m to 3.20) and it is fastened to the ceiling by a pair of metal cables of variable length.

To this end both the installation and the removal of a poster from the supporting bar become difficult, and in some respects, even dangerous activities.

Indeed, as one can easily imagine, the whole installation and removal operation is carried out by a worker on a ladder and by another worker from the ground, due to safety reasons.

The operation fastening the poster to the poster holder requires the worker on the ladder to properly introduce the poster edge between the rollers and to engage it therein, without damaging or creasing the poster (typically made of paper or the like), making it necessary to replace it.

Such operation involves some difficulties since the worker on the ladder shall grasp the ladder by one hand and only with the other hand he/she shall fix in place the poster, that typically has considerable dimensions affecting the whole operation.

In this respect it has to be noted that it is not unusual to work with posters even of 5 or 6 m in length, which have a weight of about 6-10 kg, depending on the material they are made of.

To this end the poster holder often is not used or the poster is inappropriately fastened thereto (usually by adhesive tape or the like).

Even the poster removal step is difficult, since the mechanism with facing rollers, by clamping the poster, requires the worker on the ladder to carefully work, in order to avoid the poster from being torn leaving pieces between the rollers which should be removed before fastening a new poster.

In addition it has to be noted also that, due to the recent marketing principles, the fact of displaying the poster in a wrong way adversely affects the advertisement of special offers or advertising campaigns to the public.

A further drawback in prior art of poster holders is related to the fact that in some cases the poster shall be exposed outdoor: this arrangement causes the poster to be subjected to the wind, with the risk that, if it not secured at the bottom thereof, it moves waving about the upper metal bar.

OBJECTS AND SUMMARY OF THE INVENTION

The object of the present invention is to overcome the drawbacks of the prior art.

Particularly, the object of the present invention is to provide a poster holder where the operations for fastening and removing the poster are simple and can be carried out in complete safety even by only one worker from the ground.

These objects are achieved by a poster holder according to the first annexed claim.

In particular, the basic idea of the present invention is to provide a poster holder comprising a first part, or support, intended to be firmly suspended from the ceiling and a second part, or engaging bar, provided with at least a seat for engaging a poster edge and removably connectable to the support, such that it is possible, firstly, to fasten the poster to the bar and then, later, to secure the bar to the support, thus suspending the poster.

The step fastening the poster to the seat of the bar can be advantageously carried out from the ground, so as to avoid working on a ladder.

Moreover in the step securing the bar to the support the poster is not subjected to the risk of being torn, since the bar keeps it in the proper deployed condition.

Then, advantageously, the bar can be secured and released from being engaged with the support by a suitable mechanism, that will be better described below, which can be operated by a clamp arranged at the end of a rod handled by a worker from the ground.

Thus both the steps suspending and removing the poster can be carried out by a worker from the ground, preventing the worker from being subjected to any risks and guaranteeing a very simple operation.

BRIEF DESCRIPTION OF THE DRAWINGS

Now the invention will be described below with reference to not limitative examples, provided by way of example and not as a limitation in the annexed drawings, wherein.

DETAILED DESCRIPTION OF THE INVENTION

Figure 1:
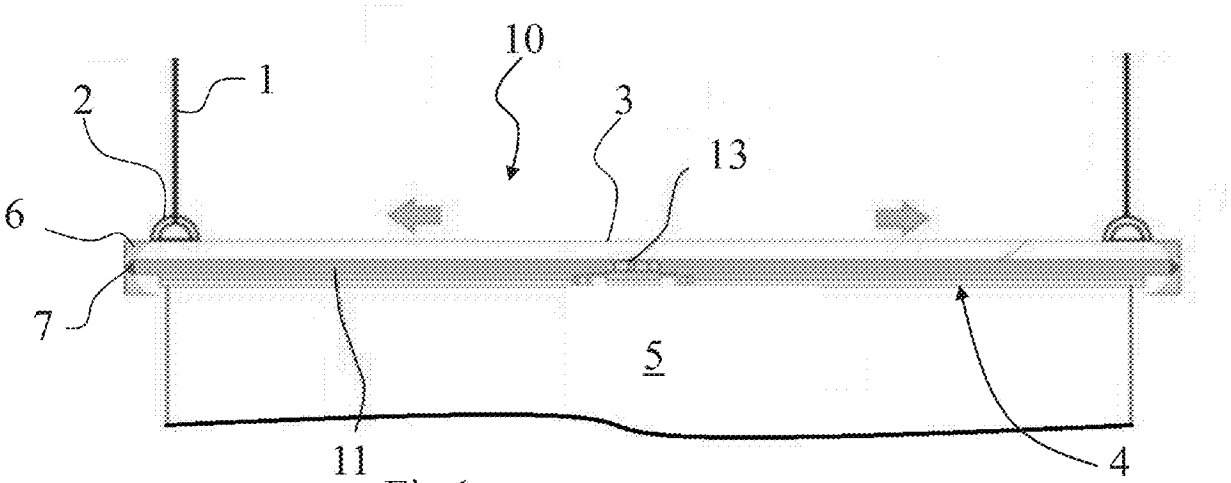
FIG. 1 is a front view of a poster holder according to a first embodiment of the present invention in its mounted position.

While the invention is susceptible of various modifications and alternative forms, certain relevant illustrated embodiments thereof are shown in the drawings and will be described below in detail. It should be understood, however, that there is no intention to limit the invention to the specific embodiment disclosed, but, on the contrary, the intention of the invention is to cover all modifications, alternative forms, and equivalents falling within the scope of the invention as defined in the claims.

The use of "for example", "etc", "or" indicates non-exclusive alternatives without limitation unless otherwise noted. The use of "including" means "including, but not limited to," unless otherwise noted.

The possible use of terms such as "horizontal" or "vertical", useful for explaining the invention, refers to the poster holder in the proper mounted condition, when hung from a ceiling or suspended from a vertical wall and with reference to the normal use of such indications ("vertical" is a direction substantially parallel to the direction of the weight force, while "horizontal" is a direction substantially perpendicular to the vertical one).

Before entering in the detailed description of the annexed figures, it is useful to shortly describe the main features in common to the several embodiments shown in the drawings.

Widely speaking the poster-holder 10,10',10",10'" according to the present invention comprises a support 3,3',3",3* intended to be suspended on a wall.

To this end the support can be in the form of a case or another form suitable for the purpose, provided that it is equipped with at least one engagement seat 6,600,6",6*,6'" with which a bar 4,4',4" of the poster-holder cooperates.

In the preferred embodiments shown in annexed drawings the support has a substantially case-like form without the lower wall: this form, to be intended as not limitative, in addition to a general pleasant aesthetical appearance has also a certain greater stoutness with respect to other forms.

With reference to the bar 4,4',4" in turn it comprises a fixed length lower portion 18,18',18" provided with at least one gripping device for making an engagement with an edge of a poster 5.

Such gripping device can change depending on the type of poster desired to be used: in some cases the poster is provided with a simple straight edge, in other cases on the contrary the edge of the poster is shaped like a pocket, that is it provides an eyelet wherein a rod is inserted or can be inserted, which facilitates the coupling and suspension (for example in the case of very heavy posters or posters exposed to the action of weathering agents—particularly the wind).

Depending on the type of poster, therefore, the gripping device is shaped like a clamp, an elongated retaining lip or others; a preferred, but not limitative, embodiment wherein the gripping device has at least one notch delimited by retaining lips, where the edge of the poster is fitted is shown in the annexed drawings and is discussed below.

Advantageously the bar 4,4',4" further has at least one slider 11,11',11",11'" slidably associated to said lower portion 18,18',18": in detail the slider 11,11',11",11'" is insertable into the engagement seat 6,600,6",6*,6'" in order to accomplish a removable coupling between the support 3,3',3",3* and the bar 4,4',4".

More in detail the several not limitative shown embodiments have all in common the fact that the slider 11,11',11",11'" is movable at least between a first and a second positions: the first position corresponds to a condition disengaged from the respective seat 6,600,6",6*,6'", while the second position corresponds to a condition engaged with the seat 6,600,6",6*,6'".

Advantageously, in all the embodiments, the poster holder further comprises at least one elastic member 13,13',13",13'" acting (directly or indirectly) on the slider 11,11',11",11'" in order to define a firm coupling with the respective engagement seat 6,600,6",6*,6'".

The term "firm coupling" here means that, without applying a disengaging or releasing force by the user, the elastic member acts (due to its intrinsic elastic properties) on the slider by keeping it in the condition engaged with the seat: in order to disengage both of them it is therefore necessary to apply a certain force sufficient for overcoming that of the elastic member itself; vice versa the disengaging condition is a non-firm condition, meaning that in order to keep the slider in such condition it is necessary to apply a force opposing that of the elastic member.

Preferably, further, in the embodiments that will be discussed below, the poster holder comprises two sliders slidably associated to said lower portion and intended to move in the same direction and in opposite sense, it being further provided on said case at least one seat for the engagement of each slider.

Now with a specific reference to FIG. 1, it shows a first basic embodiment of a poster holder 10 in the displayed condition fastened to a ceiling (not shown) or more in general to a wall (possibly even a vertical one) by a pair of steel cables 1 engaging corresponding rings or lifting eyebolts 2.

From now on it has to be noted that steel cables may be equally replaced by metal bars, cables made of plastic or composites or further similar suspension means; further as an alternative instead of the cables 1 simple dowels, screws or the like could be provided which secure the poster holder 10 to a wall, especially if this latter is a vertical wall, the edge of a window or a shop window, the glass thereof or the like.

Rings 2 are applied to or however attached to or as one piece with the support 3 of the poster holder 10.

In the present embodiment the support 3 has a case-like form.

FIG. 1 shows also a part of a poster 5 supported by the poster holder 10 in its displayed deployed position.

The poster holder 10 according to the present invention comprises, in addition to the support 3, also a second part, or engaging bar 4, provided with at least one gripping device for engaging an edge of the poster; so the engaging bar 4 holds the poster 5.

Figure 3:
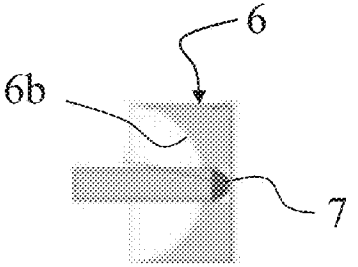
FIGS. 2-4 are details of the poster holder of FIG. 1.
Figure 4:
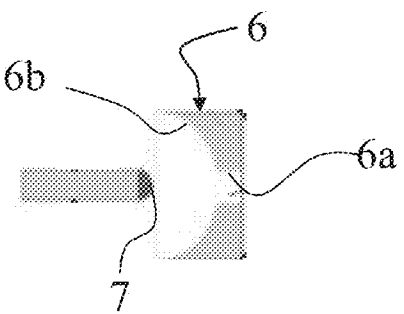
Figure 2:
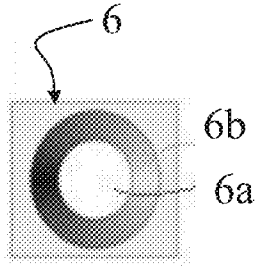

As regards constructional details make reference also to FIGS. 2, 3 and 4 showing some details of the support 3 and of the bar 4.

Widely speaking the engaging bar 4 is removably connectable to the case 3, such that, at first, it is possible to fasten the poster to the bar and then, later, to couple the bar 4 to the support 3, therefore suspending the poster 5 without being affected by the drawbacks related to forms known in the prior art and set forth above.

Entering more into details, in this first embodiment the support 3 has an elongated shape and two engagement seats 6 provided at both ends.

Each one of the two engagement seats 6 comprises a guiding profile **6*b* that is concave or anyway provided with walls inclined with respect to the longitudinal central axis of the bar 4** in the mounted condition.

In this example the concave guiding profile **6*b* slopes down towards a through hole 6*a* substantially arranged centrally of the concave guiding profile 6*b*, as it can be clearly seen in FIGS. 3 and 4**.

From now on it has to be noted that in other variants the hole **6*b* has a blind bottom, depending on needs, and it can be also completely omitted: in the latter case the engagement is merely guaranteed by the concave shapes of the guiding profile 6***b*, that, as it will be seen below in detail, allow the bar 4 in the operating condition to obtain a firm balance position.

Moreover this characteristic, together with the fact that the concave shapes of each concave guiding profile 6*b* of each seat 6 are faced each other, advantageously accomplishes a self-centering function of the bar 4 in the mounting step, below further reference will be made thereto.

The support 3 preferably is developed according to a cylindrical symmetry and in the figures it is shown in a sectional view taken along a diameter thereof; obviously one or more portions of the shell wall may be omitted and the support 3 may have a shape different than the case one, it being for instance open on several sides, even till taking an overall "C" or reversed "U" shape without for this reason departing from the teaching of the present invention.

Further, as an alternative, from now on it has to be noted that the support in case it is shaped like case 3 may take any polygonal shape (prismatic, pyramidal, rhomboidal, conical, hexagonal etc etc), even possibly without several shell walls.

Figure 7:
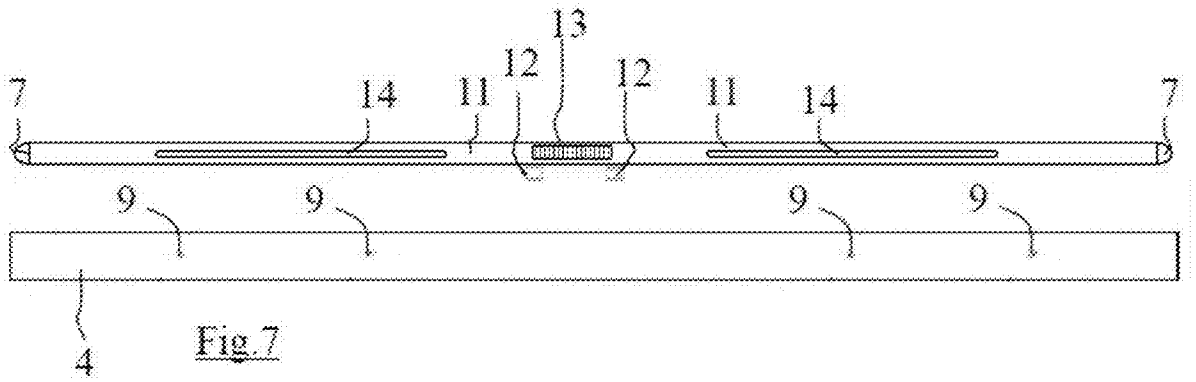
FIG. 7 is a front view of a part of the poster holder of the previous figures.
Figure 8:
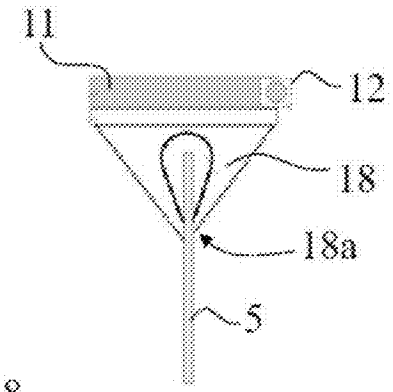
FIG. 8 is a cross-sectional view of the part of the poster holder of FIG. 7.

The engaging bar 4 comprises several parts, shown in annexed FIGS. 7 and 8; the engaging bar 4 particularly comprises a fixed length portion 18, provided with a gripping device for the poster 5, and at least one slider characterizing an extendable or movable portion, associated to the fixed length portion and intended to allow the bar 4 to be engaged with the support 3: thus advantageously the poster is prevented from being folded or damaged in the step attaching/removing the bar 4 on the support 3.

The fixed portion of the bar 4 is shown in a sectional view in FIG. 8, where it is noted that the fixed length portion 18 is equipped with the fixed length gripping device 18*a* that accomplishes the engagement with the poster 5: in this example the gripping device 18*a* comprises a notch delimited by free edges 18*a* that form opposite elastic retaining lips, the poster being inserted therebetween and being clamped by the elastic retainment generated therebetween.

The portion 18 in this embodiment has a triangular shape as a whole, (but it can have other shapes).

Optionally additional engaging means can be further provided, especially if the poster is particularly heavy, such as holding pins secured to the portion 18 and on the poster 5 that, even if make the assembly slightly more complicated, allow very heavy posters to be suspended, for example made of fabric or the like.

In other embodiments the cavity of the notch is wide enough to house a rod inserted into a pocket made of the poster edge: the rod (and so the poster) are therefore kept in place by the retaining lips but due to a mechanical fit effect; in this way, therefore, the retaining lips can also be not elastic, but rigid, since the rod and the poster edge are typically inserted by acting sideways.

In the example shown the poster holder 10 comprises two sliders 11 fastened so as to slide to the portion 18, in particular in this example they are fastened above the latter; it has to be pointed out that sliders 11 may be fastened even at the sides or in other positions without for this reason departing from the teaching provided herein.

Each slider 11 in this example substantially extends from one end of the bar 4 up to almost the centre; in other embodiments on the contrary the sliders are shorter and their extension involves only the central portion; obviously in such solutions, the seats are placed at suitable areas of the support.

More in details each slider 11 has a free end 7 intended to be fitted into the holes 6*a* in the mounted condition, such as shown in FIGS. 3 and 4 immediately before the engagement takes place and after the engagement has took place respectively.

Then the end of the two sliders 11 opposite to the free one 7 is associated to a an elastic member, such as the spring 13 (or as an alternative an elastomeric element), which is placed between the two sliders 11, such that, by overcoming the elastic strength of the spring 13, it is possible to move them close to each other or to move them away from each other.

Each member 11 is slidably attached to the portion 18 by the linear rails 14 provided on the sliders 11, with pins 9 fixed on the lower portion 18 sliding therein.

Pins 9 can be as one piece with the lower portion 18 or can be applied thereto by known methods (they can be screwed, welded or so on).

Pins 9 engage the linear rails 14 and are equipped, for instance, with an enlarged head so that they can freely slide into the rails 14 upon the movement of the sliders 11, and they engage the rails 14 in a movement direction perpendicular to that of the sliders 11.

The linear rails 14 are substantially made as an elongated slot, and they extend for at least a part of the slider 11 where they are provided; obviously in the shown example it has been chosen to have only one rail for each slider 11, but even two, three or more of them can be provided.

Thus, shortly, the lower portion 18 can be suspended from the sliders 11, which however are free to move sideways (that is to slide) without their movement causing the poster to be folded, which is engaged to the lower fixed length portion 18.

Figure 5:
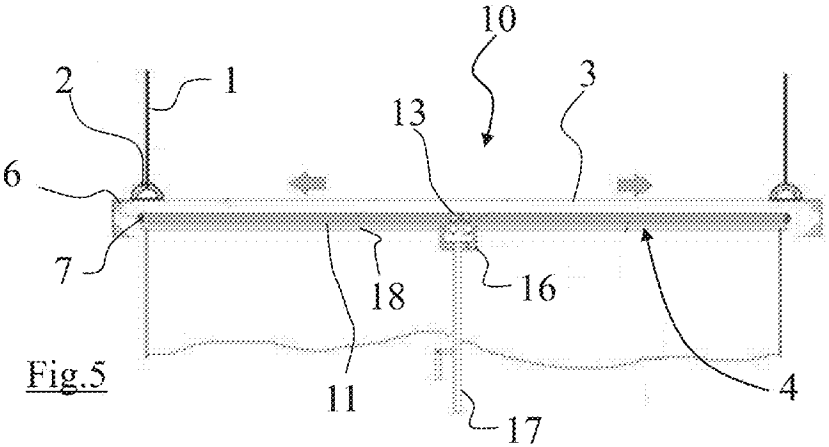
FIG. 5 is a front view of the poster holder of the previous figures in a first mounting step.
Figure 6:
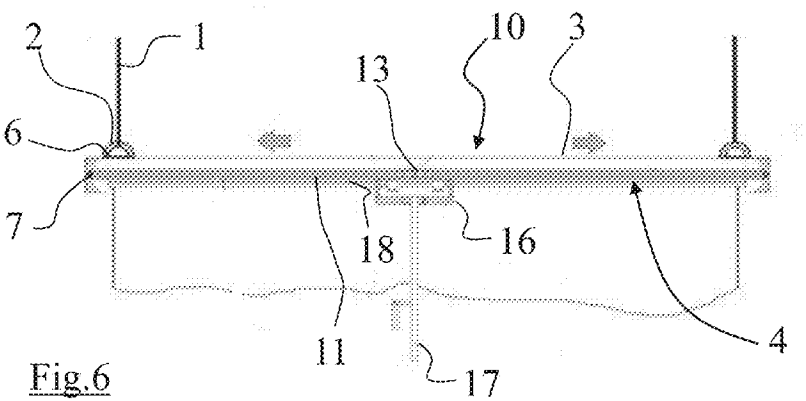
FIG. 6 is a front view of the poster holder of the previous figure in a second mounting step.

Each slider 11 is further provided with a gripping means 12, for example an eyelet, a clamp 16 attached to the end of a rod 17 acting thereupon, shown in FIGS. 5 and 6.

Therefore the slider 11 is moved by acting on the gripping means 12 and by overcoming the strength of the spring 13: more in details when the clamp 16 holds the two gripping members 12 (such as in FIG. 5) overcoming the elastic strength of the spring 13, the sliders 11 are moved close together and the ends 7 are correspondingly retracted.

When the clamp 16 releases the two gripping means 12 (as in FIG. 6) the spring 13 moves the sliders 11 away from each other, whose free ends 7 project sideways such to engage the holes 6*a*.

Such engagement movement is advantageously assisted by the provision of the concave guiding profiles 6*b*, which properly guide each end 7 towards the hole 6*a*.

The provision of the guiding profile allows a user to properly engage the bar 4 with the support 3 even if he/she is working from the ground: a possible (and probable) pivotment of the rod 17 (to which the clamp 16 is attached) weighed down by the weight of the poster 5, is balanced by the guiding profiles 16*b* that guide the ends 7, outwardly pushed by the spring 13, such to be firmly fitted into the holes 6*a*, balancing a possible not so much accurate positioning.

The length of the spring 13 can be selected such as it keeps a more or less slight compressed condition even when the sliders 11 are in their respective outermost position, and namely when the free ends 7 are engaged into the engagement seats 6 respectively, such to guarantee an optimal retaining action.

In this way pins 9 by abutting against the end of the rails 14 practically act as a stop and they stop the movement of the sliders 11 before the spring 13 reaches its complete deployment.

The engagement of each end 7 into the respective engagement seat 6, provides the supporting force necessary to suspend the bar 4 on the fixed case 3.

In an alternative embodiment (not shown) that for example can be preferred in case of particularly small posters or also in case of posters to be arranged not at very high heights with respect to the ceiling, the poster holder 10 of the present invention can be provided only with one slider 11.

A spring 13 will again exert the suitable compression on said slider 11, similarly to what described above, while the other slider is for example replaced by a fixed pin, integral with the bar.

Figures 9, 10:
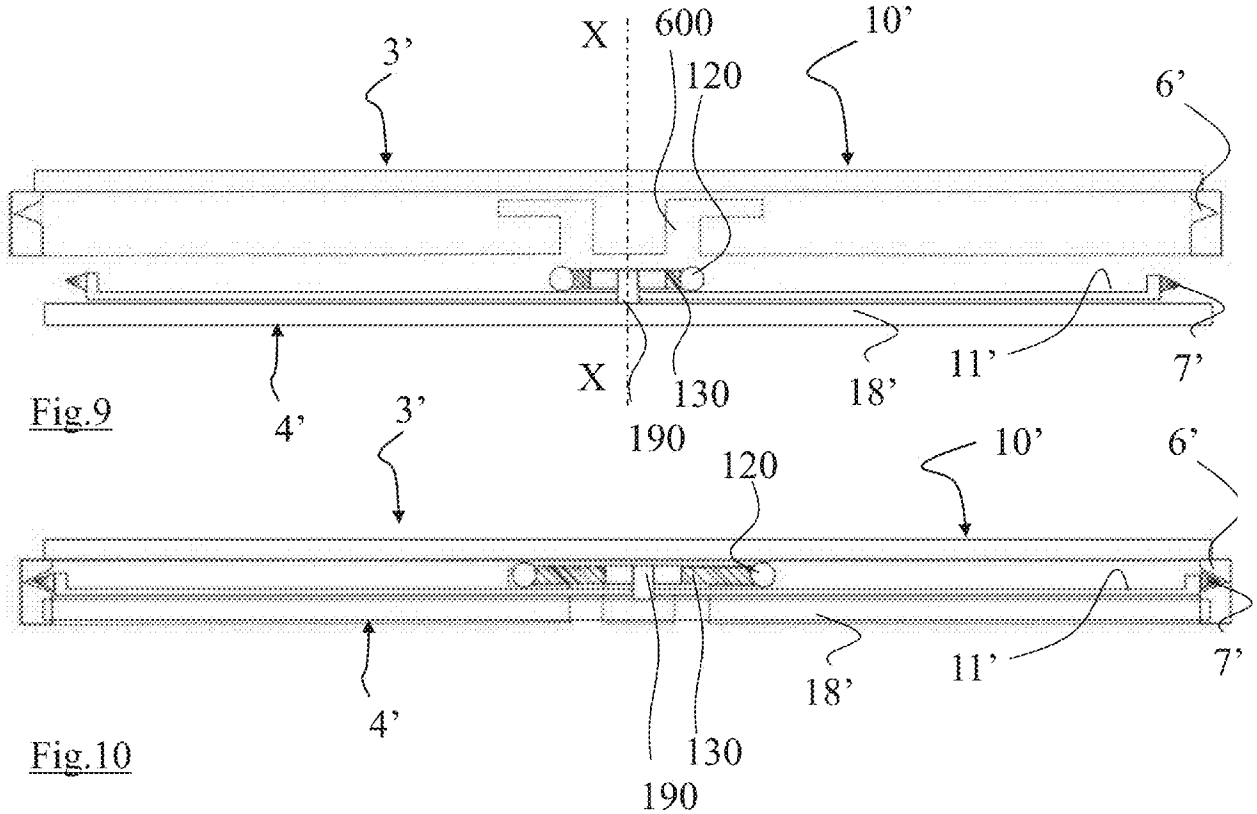
FIG. 9 is a front view of a second more developed embodiment of the poster holder of the present invention in a first mounting step.
FIG. 10 is a front view of the poster holder of the previous figure in a second mounting step.

A particularly interesting variant is that of FIGS. 9 and 10.

Therein the reference number 10' generally denotes a poster holder according to this second embodiment, that is particularly useful when it is necessary to suspend posters having a considerable width extension (that is in the horizontal direction, in the mounted condition) and/or considerably heavy posters.

In this embodiment the same numerals followed by a prime symbol ' denote the same parts already described with reference to the previous figures, therefore reference thereto will not be made.

When it is necessary to suspend posters having a considerable width extension (that is in the horizontal direction, in the mounted condition) and/or considerably heavy posters, the Applicant has found that due to the considerable weight and to the considerable extension a bending arrow is generated approximately at the centre of the poster holder, which results in the poster unproperly displayed and in the risk of bending or damaging it.

In order to avoid such deformation it would be possible to suggest it to be made more strong, particularly by increasing the involved thicknesses, but this inevitably leads to an increased weight that in principle is not desirable, for example because the bar 4 has to be lifted up to the case 3 by the rod equipped with the clamp described above and therefore it is advisable for its weight to be as low as possible.

In this case the Applicant has provided the poster holder 10' that comprises a support 3', substantially like the support 3 and that can be associated to the bar 4'.

The latter comprises a fixed portion 18' and an extendable portion, which comprises the sliders 11'.

The fixed portion 18' is made like the fixed portion 18 described above and it engages the poster by the same technical solutions, therefore reference thereto is not made.

From now on the poster holder 10' is described with reference to one of its two portions specular with respect to the axis of symmetry X of FIG. 9, the other portion being made in a similar way.

Even here the support 3' is provided with engagement seats 6', that in this example are cone-shaped and are intended to be firmly coupled with the pins 7' arranged at the free end of each slider 11', accomplishing a self-centering function as already described with reference to the poster holder 10.

The sliders 11' are moved away from each other by the action of respective elastic members, such as springs 130 (or similar elastomeric elements) each one extending between a common engaging member 190 fastened to the fixed length portion 18' of the bar 4' and a gripping and engaging means 120.

The latter acts for a first function as a gripping means (similarly to the gripping means 12) for driving the sliders by a clamp, as described above; more in detail the gripping and engaging means 120 extend also in a plane perpendicular to that of the sheet in FIGS. 9 and 10.

Moreover, in the present example, the sliders engage also into the engagement seats 600 of the support 3': thus engagement seats are provided both at the ends of the support and at a central portion thereof: thus a function for the vertical engagement (in the mounted condition) of the bar 4' is accomplished which is provided even in the area where there is a greater likelihood of deformation, overcoming the problems described above.

The seats 600, particularly, have a L shape and they allow the gripping and engaging means 120 to be inserted.

Seats 600 have a first vertical portion and a second horizontal portion: upon the installation of the bar 4' to the support 3', the gripping and engaging means 120 pass into the vertical portion, then, by releasing the clamp they are subjected to the action of the springs 130 that urge them (together with the sliders 11' integral thereto) along the horizontal portion of the seats 600 till abutting against the bottom thereof.

Thus the gripping and engaging means 120 have multiple functions: by means of them the movement of the sliding members 11' is controlled, their sliding is stopped at a predetermined length (when pins 7' engage the seats 6') and they centrally support the bar 4' thus allowing the weight forces thereof and of the poster to be released on a plurality of points on the case 4', thus preventing deformations (arrows), if any, from being formed.

Therefore the connection between the fixed portion 18' and the extendable one of the bar 4' as well as the overall operation of the poster holder 10' are substantially similar to those of the first embodiment 10.

Even in this case it may be equally possible to provide the use of only one slider 11' instead of the two of the shown example.

Still another embodiment is that shown in FIG. 11 wherein the same numerals followed by a double prime symbol " denote the same parts as those already described with reference to the previous figures, therefore reference thereto in not made.

In this case the sliders 11" are particularly short and they end far before the ends of the case 3".

The condition of the bar 4" engaged on the support 3" (even in this case like a case) is therefore guaranteed by the central seats 6" upon which the gripping means 12" and/or the closest portion of the slider 11" associated thereto engage.

Therefore in this embodiment the engagement takes place only at one central region of the case 4".

The sliders 11" are integral with the gripping means 12" and are drawn in the direction of the free ends of the bar 4" by the elastic members, for example springs 13" or elastomeric elements, which keep the gripping means 12" in the condition moved away from each other.

Such elastic members 13" are associated, on one side to the corresponding slider 11' and on the other side to a reversed "U" shaped retaining structure 41" secured on the fixed length portion 18" of the bar 4".

The advantages deriving from this solution mainly relate to the fact of being very light and to the fact that during the step for coupling the bar 4" to the support 3" the proper insertion and coupling takes place in a better way: due to the distance from the gripping means in the previous solutions it may happen that a small degree of inclination of the bar 4" becomes (at the ends of the bar) a considerable linear movement: in this case, since the coupling point is near the gripping point, even in case of inclination of the bar the coupling action is facilitated.

Figure 11:
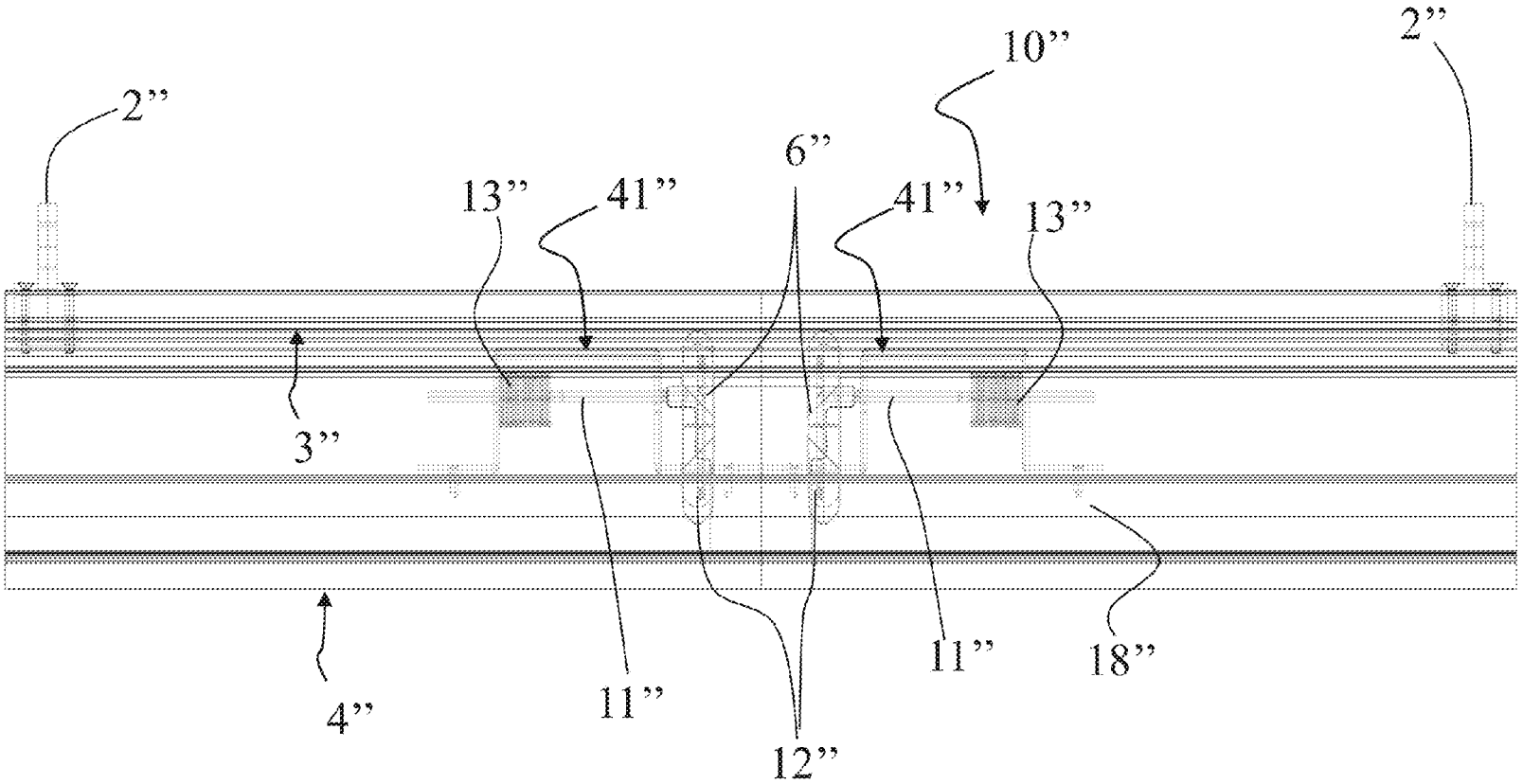
FIG. 11 is a variant of the poster holder of the present invention.
Figure 12:
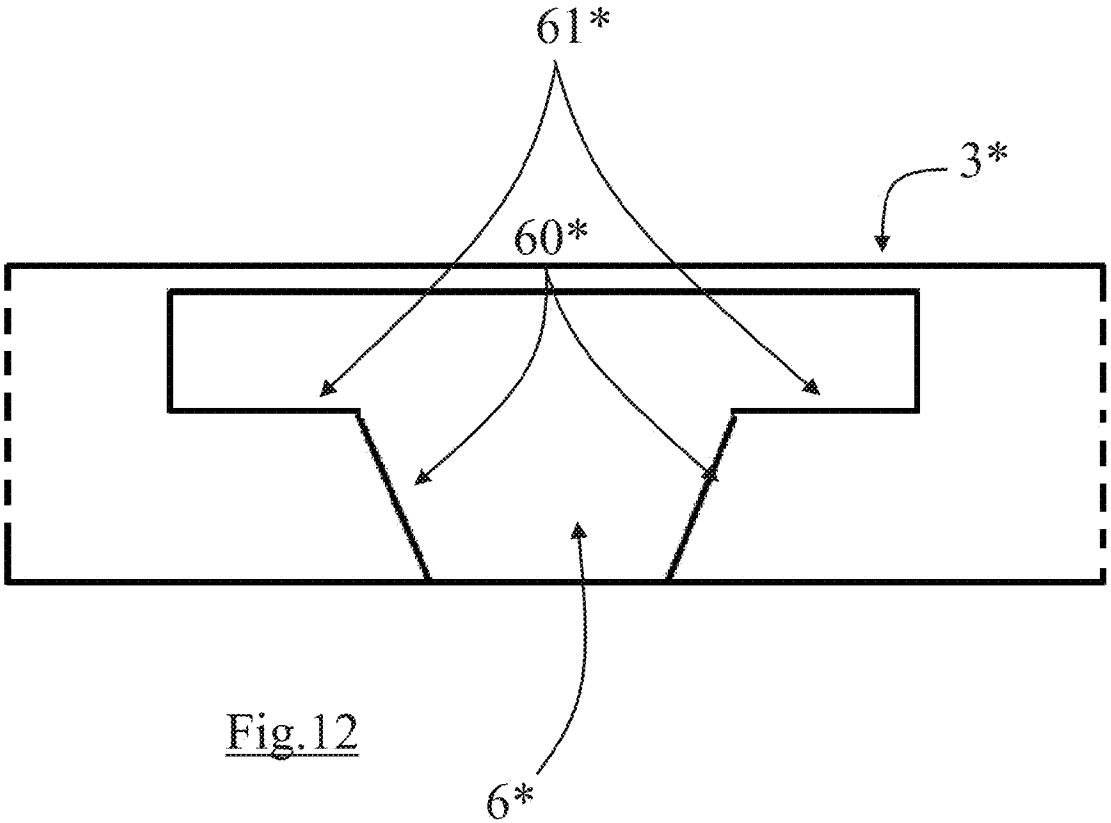
FIG. 12 is a variant of a detail of the poster holder of the present invention.

FIG. 12 shows a variant of the general shape of the engagement seat denoted by 6* for example applicable to the embodiment of FIG. 11, or more in general, also to the embodiment of the support 3' described above: in this variant the seat 6* comprises inclined guiding walls 60* connected to undercut side areas 61*: when the sliders or part thereof are inserted into such seat 6*, a guiding action takes place by the inclined guiding walls 60* which leads to the proper coupling with the undercut side walls 61*; in this manner even under a not much accurate insertion condition, due to a not optimal coupling action (for example due to the reasons mentioned above) it is possible to guarantee the bar to be properly fastened to the support accomplishing the self-centering function already provided in seats 6 of the first embodiment.

Figure 13:
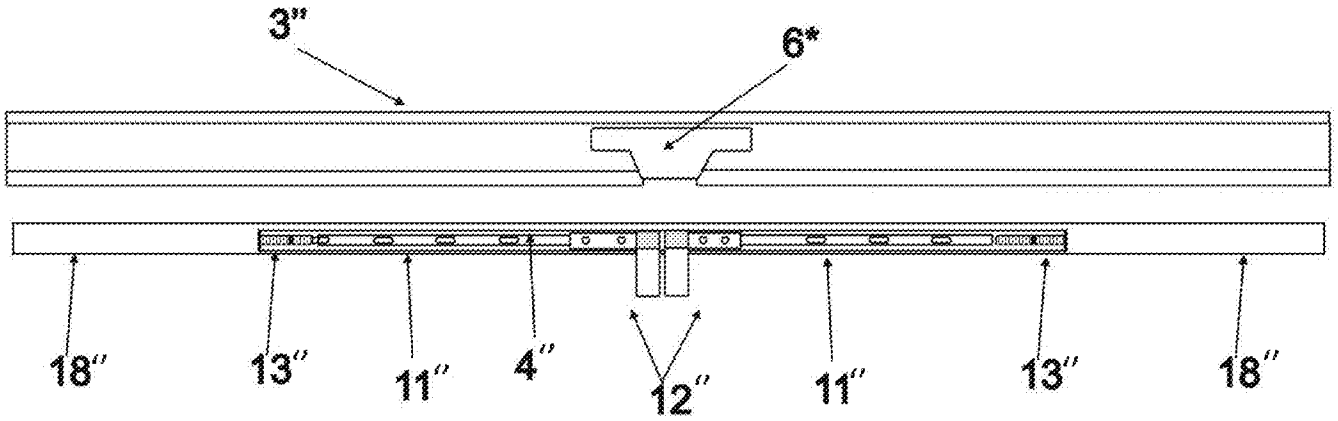
FIGS. 13-14 are another variant of the poster holder of the present invention.
Figure 14:
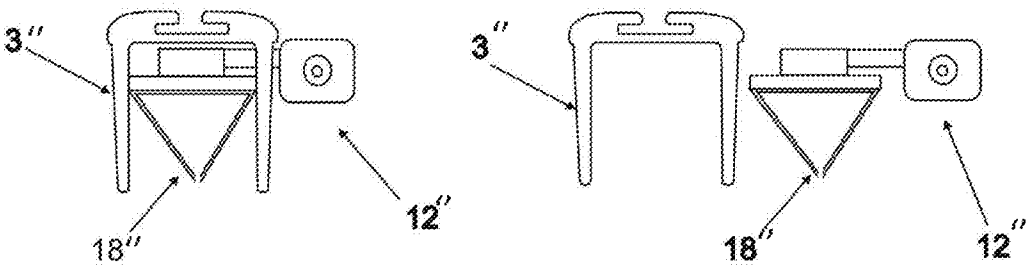

With reference to FIGS. 13 and 14 they show still another variant of the present invention, wherein the same numerals denote the same parts as those described up to now.

As it can be noted it shows the engagement seat as 6* shown with reference to FIG. 12, and a central coupling, as shown with reference to FIG. 11 with the only difference with respect thereto, that it is not provided with "C" shaped structures 41", but the elastic members 13" acting on the sliders 11" are arranged at the ends thereof opposite to those provided with the gripping means 12 and fastened to abutments in turn integral with the fixed portion.

Figure 15:
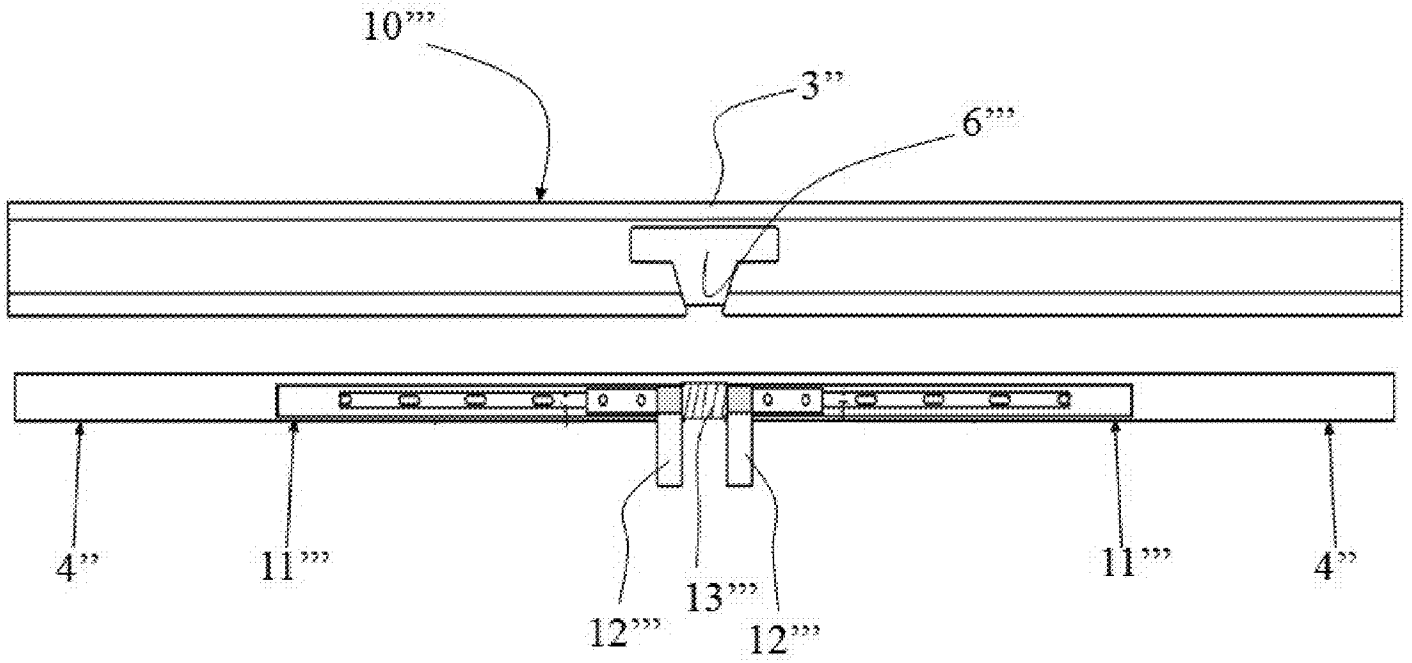
FIG. 15 is still another variant of the poster holder of the present invention.

With reference to FIG. 15 it shows still another variant of the present invention, wherein the same numerals denote the same parts, therefore reference thereto is not made.

In this variant, like the variant described with reference to FIG. 11, the engagement between the case 3" and the bar 4" is obtained only in the central part, where the gripping means 12" are drawn in the direction of the free ends of the bar 4" by a central elastic member, for example the springs 13" or elastomeric elements, which keep the gripping means 12" in the condition moved away from each other, such to cause them to cooperate with the seat 6'" that in this example has a "T" shaped notch, but it can be made in the same way as seats 600, or even as seats 6" and/or 6*.

Figure 16:
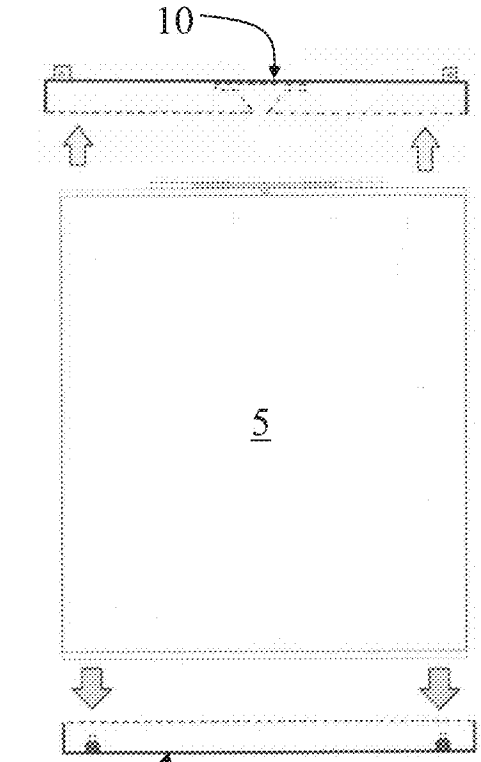
FIGS. 16-19 are a developed variant of the poster holder of the present invention.
Figure 17:
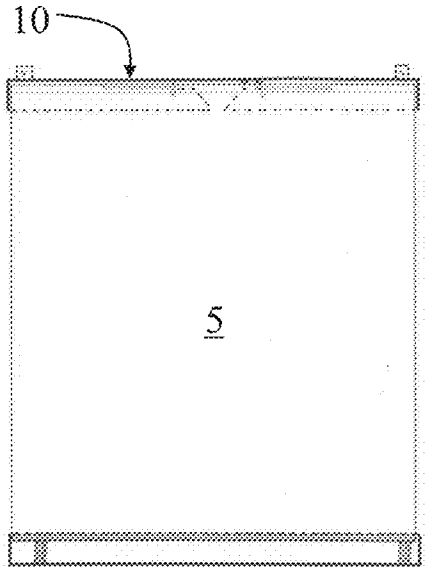

With reference to FIGS. 16 and 17 they show another improved variant of the poster holder described up to now.

This variant is particularly useful if it is necessary to fasten a displayed poster such to keep it in a perfectly stretched manner, for example when it is necessary to put it up in an outdoor environment, where the poster is subjected to the wind action, that may cause it to wave.

In this case the a lower bar 400 is added to the poster 10 (or equally one of the other variants described above) which engages the poster P at its lower edge.

Figure 18:
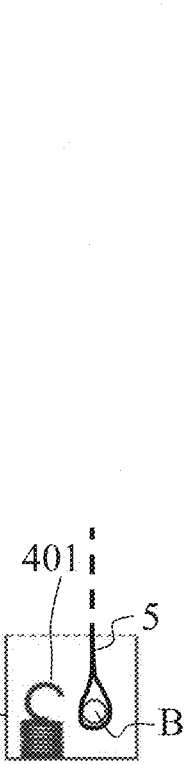
Figure 19:
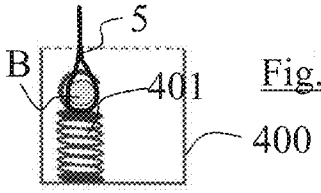
Figure 20:
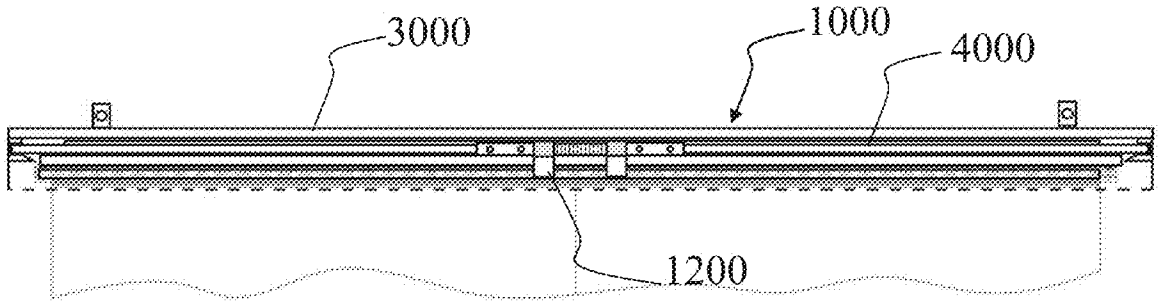
FIGS. 20-23 are still another variant of the poster holder of the present invention.
Figure 21:
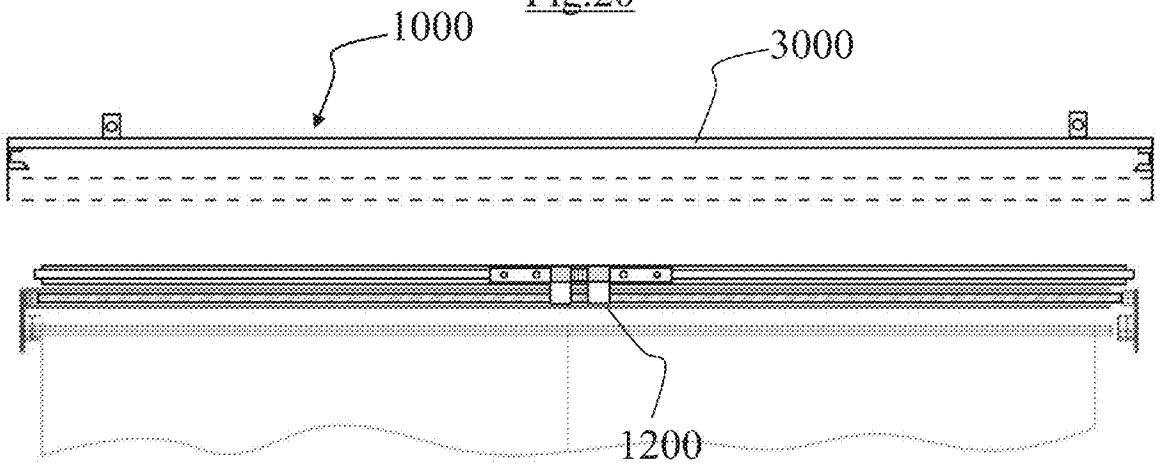

To this end the lower bar 400 comprises a fixed length portion, substantially similar to the portion 18 already described above, and provided for example with retaining lips for the edge of the poster 5 and with springs and hooks 401 (such as in FIGS. 18 and 19) which grasp a rod B fitted into a pocket made on the lower edge of the poster 5.

A particularly advantageous variant is shown in FIGS. 20-23 in different views and/or details.

In this variant the poster holder is denoted as a whole by 1000 and it comprises the support 3000 and the bar 4000 with sliders 1100.

The general operation is like that of the embodiments already described and therefore reference thereto is not made.

Figure 22:
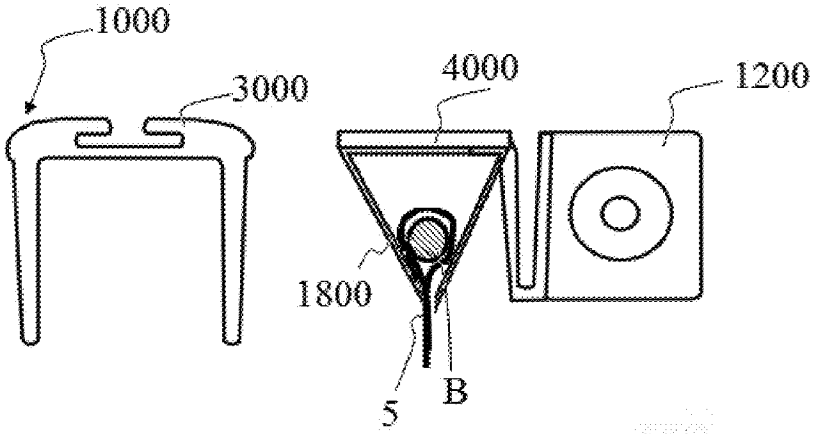
Figure 23:
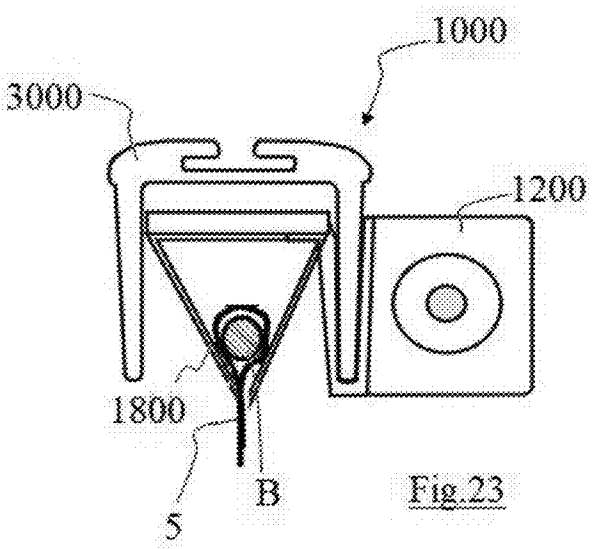

The pecularity of this embodiment is that the support 3000, as it can be seen in the detail of section views of FIGS. 22 and 23, is made by a simple profile member, for example made of aluminum, closed on three sides.

The sliders 1100 to this end are provided with gripping means 1200 provided with a notch such to be housed partially into the case of the support 3000 and partially outside it, and without requiring the support 3000 to be processed along its longitudinal extension, advantageously for economy and manufacturing simplicity.

The removable coupling between the bar 4000 and the support 3000 occurs as already described, like, for example what described for the solution of FIGS. 1 and 2, therefore reference thereto is not made.

A further object of the present invention is also a poster holder kit comprising a poster holder according to the invention and a clamp 16 arranged at one end of a rod 17 and operable substantially from an opposite end of said rod 17, said clamp 16 being arranged for cooperating with the gripping means of the sliders.

It has to be pointed out that several modifications and variants can be applied to the poster holder according to the present invention for example with reference to the number and the position of the pairs of holes-pins used, or to the shape of the fixed and removable portions, or even to the material the poster holder is made of.

For example one of such variants, in addition to those described above, regards the fact that instead of the spring it is possible more generally to provide a suitable elastic member: for example a gas spring, a metal spring having a shape different than the helical one (for example a disc-like shape or the like) or even a suitable plastic elastomer.

Furthermore in a general meaning it has to be noted that the poster holder hereinabove described and below claimed can be used also for suspending, besides poster in a strict sense, also flexible plates or more in general sheet elements, in any material, such as curtains, drapes or similar.

All the above mentioned modifications and variants shall be considered as obvious for people skilled in the art and therefore falling within the protection scope of the present invention as claimed below.

The invention claimed is:

1. Poster holder (10,10',10",10'",1000) characterized in that it comprises a support (**3,3',3",3*,3000) intended to be suspended on a wall and provided with at least one engagement seat (6,600,6",6*,6'") and with a bar (4,4',4") comprising in turn a fixed length lower portion (18, 18',18") comprising a gripping device for engaging an edge of a poster (5) and comprising two sliders (11,11',11",11'",1100) where each slider has a free end (7) said sliders (11,11',11",11'",1100) being slidably associated to said fixed length lower portion (18, 18',18"), said sliders (11,11',11",11'",1100) being insertable into said engagement seat (6,600,6",6*,6'") such to make a connection between said support (3,3',3",3*) and said bar (4, 4',4") said sliders being adapted to move in the same direction and in opposite directions, and said support (3,3', 3",3*) having at least one engagement seat (6,600,6",6*,6'") for each slider (11,11',11", 11'",1100**).

2. Poster holder (10,10',10",10'",1000) according to claim 1, wherein said sliders (11,11',11", 11'",1100) are movable at least between a first and a second positions, said first position corresponding to a disengaged condition from said engagement seat (**6,600,6",6*,6'") and said second position corresponding to an engaged condition with said engagement seat (6,600,6",6*,6'") wherein the poster holder further comprises at least one elastic member (13, 13',13",13'") acting on said sliders (11, 11',11",11'",1100) in order to cause said sliders to be coupled with said engagement seat (6,600,6",6*,6'"**).

3. Poster holder (10,10',10",10'",1000) according to claim 2, wherein said engaged condition is a firm condition, with said elastic member (13,13',13",13'") acting on said sliders (11,11',11",11'") in order to firmly keep said sliders in said engaged condition, wherein said disengaged condition is a non-firm condition.

4. Poster holder (10,10',10", 10'",1000) according to claim 1, wherein said engagement seats are substantially arranged on opposite ends of said support (**3,3',2",3*, 3000**) with respect to a longitudinal development thereof.

5. Poster holder (10,10',11", 10'",1000) according to claim 1, wherein said engagement seats are substantially arranged centrally on said support (3,3',11",3*, 3000) with respect to a longitudinal development thereof.

6. Poster holder (10,10',11",10''',1000) according to claim 1, wherein said engagement seat (6) comprises a concave guiding profile (6*b*) and a hole (6*a*), said hole (6*a*) being provided substantially centrally of said concave guiding profile (6*b*).

7. Poster holder (10,10',11", 10''',1000) according to claim 1, wherein said fixed length lower portion (18, 18') of said bar (4) comprises at least one pin (9) and said sliders (11) comprise at least one sliding rail (14) cooperating with said pin (9) in order to allow said sliders (11) to move in a first direction of insertion of said free end (7) into said engagement seat (6).

8. Poster holder (10,10',11",10''',1000) according to claim 7, wherein said pin (9) and said sliding rail (14) cooperate in order to prevent a movement in a second direction perpendicular to said first direction of insertion.

9. Poster holder (10, 10', 10", 10''', 1000) according to claim 1, wherein said slider (11) is coupled with at least one gripping means (12, 120) in order to cause it to move between said second and said first positions.

10. Poster holder kit comprising a poster holder (10, 10', 10", 10''', 1000) according to claim 2 and a clamp (16) arranged at one end of a rod (17) and operable substantially from an opposite end of said rod (17), said clamp (16) being arranged for cooperating with said sliders to move them in a disengaged condition from said seats.

* * * * *